US010308466B2

(12) United States Patent
Kim et al.

(10) Patent No.: US 10,308,466 B2
(45) Date of Patent: Jun. 4, 2019

(54) POST-PROCESSING APPARATUS INCLUDING A PUSHING MEMBER

(71) Applicant: FUJI XEROX CO., LTD., Tokyo (JP)

(72) Inventors: Younsook Kim, Incheon (KR); Jaeeun Lee, Incheon (KR); Inhwa Song, Incheon (KR); Hyunseok Lee, Incheon (KR); Youna Chu, Incheon (KR)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/718,328

(22) Filed: Sep. 28, 2017

(65) Prior Publication Data

US 2018/0265323 A1 Sep. 20, 2018

(30) Foreign Application Priority Data

Mar. 15, 2017 (JP) ..... 2017-049828

(51) Int. Cl.

| | |
|---|---|
| ***B65H 31/30*** | (2006.01) |
| ***B65H 29/00*** | (2006.01) |
| ***B41J 13/00*** | (2006.01) |
| ***B65H 31/02*** | (2006.01) |
| ***B65H 31/36*** | (2006.01) |
| ***B65H 43/00*** | (2006.01) |

(52) U.S. Cl.

CPC ..... *B65H 31/30* (2013.01); *B41J 13/0009* (2013.01); *B65H 29/00* (2013.01); *B65H 31/02* (2013.01); *B65H 31/3081* (2013.01); *B65H 31/36* (2013.01); *B65H 43/00* (2013.01); *B65H 2301/4212* (2013.01); *B65H 2301/4213* (2013.01); *B65H 2404/1114* (2013.01); *B65H 2405/11151* (2013.01); *B65H 2511/13* (2013.01); *B65H 2511/20* (2013.01); *B65H 2515/112* (2013.01); *B65H 2801/27* (2013.01)

(58) Field of Classification Search

CPC ..... B65H 31/30; B65H 29/00; B65H 31/02; B65H 31/3081; B65H 31/36; B65H 43/00; B41J 13/0009

USPC ..... 493/444, 445

See application file for complete search history.

(56) References Cited

U.S. PATENT DOCUMENTS

| | | | | |
|---|---|---|---|---|
| 5,098,074 A * | 3/1992 | Mandel | B42B 4/00 | 270/58.13 |
| 5,382,011 A * | 1/1995 | Tani | G03G 15/6541 | 270/37 |
| 5,478,062 A * | 12/1995 | Horiuchi | B42C 1/12 | 270/58.02 |
| 5,709,376 A * | 1/1998 | Ushirogata | B42C 1/12 | 270/58.11 |
| 6,217,016 B1 * | 4/2001 | Honmochi | B42C 1/12 | 270/37 |

(Continued)

FOREIGN PATENT DOCUMENTS

JP 2015-131716 A 7/2015

*Primary Examiner* — Patrick H Mackey

(74) *Attorney, Agent, or Firm* — Sughrue Mion, PLLC

(57) ABSTRACT

A post-processing apparatus includes a storing unit that stores plural recording media for performing post-processing, a pushing member that pushes trailing ends of the recording media stored in the storing unit toward an ejection port, and a controller that controls the pushing member to stop at a position at which the pushing member supports a recording medium that is transported.

11 Claims, 22 Drawing Sheets

(56) References Cited

U.S. PATENT DOCUMENTS

| | | | | |
|---|---|---|---|---|
| 6,305,681 | B1 * | 10/2001 | Watanabe | B42C 1/12 270/58.08 |
| 6,905,118 | B2 * | 6/2005 | Yamada | B65H 45/18 270/8 |
| 7,744,085 | B2 * | 6/2010 | Tsutsui | B65H 31/3081 270/58.08 |
| 7,798,950 | B2 * | 9/2010 | Kobayashi | B65H 45/18 270/20.1 |
| 7,946,568 | B2 * | 5/2011 | Hayashi | B65H 37/04 270/58.11 |

* cited by examiner

POST-PROCESSING APPARATUS INCLUDING A PUSHING MEMBER

CROSS-REFERENCE TO RELATED APPLICATIONS

This application is based on and claims priority under 35 USC 119 from Japanese Patent Application No. 2017-049828 filed Mar. 15, 2017.

BACKGROUND

(i) Technical Field

The present invention relates to a post-processing apparatus.

(ii) Related Art

In a post-processing apparatus that performs post-processing, such as stapling or punching, on a recording medium, such as a printing sheet, on which a printing operation has been performed, plural printing sheets on each of which the post-processing is to be performed are stored in a storing unit called a compilation tray, and then the post-processing is performed on the stored printing sheets.

When plural printing sheets are accommodated in a compilation tray, and post-processing, such as stapling, is performed, the vertical positions of the trailing ends of the printing sheets may sometimes not become lower depending on the type (weight) of the printing sheets, and as a result, the printing sheets may sometimes not be accommodated in the compilation tray.

SUMMARY

According to an aspect of the invention, there is provided a post-processing apparatus including a storing unit that stores plural recording media for performing post-processing, a pushing member that pushes trailing ends of the recording media stored in the storing unit toward an ejection port, and a controller that controls the pushing member to stop at a position at which the pushing member supports a recording medium that is transported.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail below with reference to the drawings.

Figure 1:
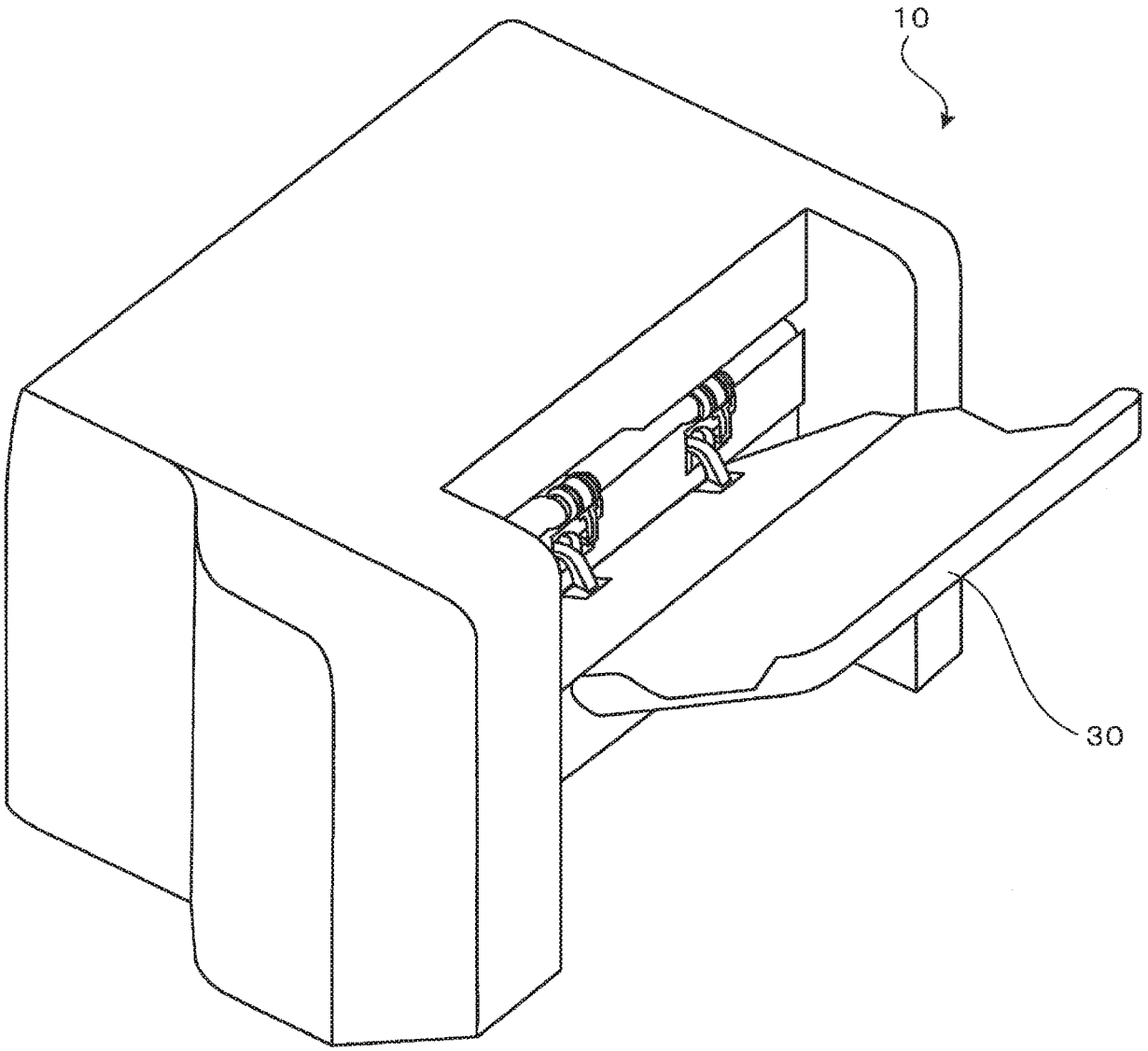
FIG. 1 is a perspective view illustrating the appearance of a post-processing apparatus according to an exemplary embodiment of the present invention.

FIG. 1 is a perspective view illustrating the appearance of a post-processing apparatus 10 according to an exemplary embodiment of the present invention.

As illustrated in FIG. 1, the post-processing apparatus 10 according to the exemplary embodiment of the present invention has a shape such that the post-processing apparatus 10 is used by being connected to a printer, which functions as an image forming apparatus. The post-processing apparatus 10 has a function of performing post-processing, such as stapling, on plural printing sheets that are recording media ejected from the printer and then ejecting a stack of the printing sheets, on which the post-processing has been performed, to an ejection tray 30.

Figure 2:
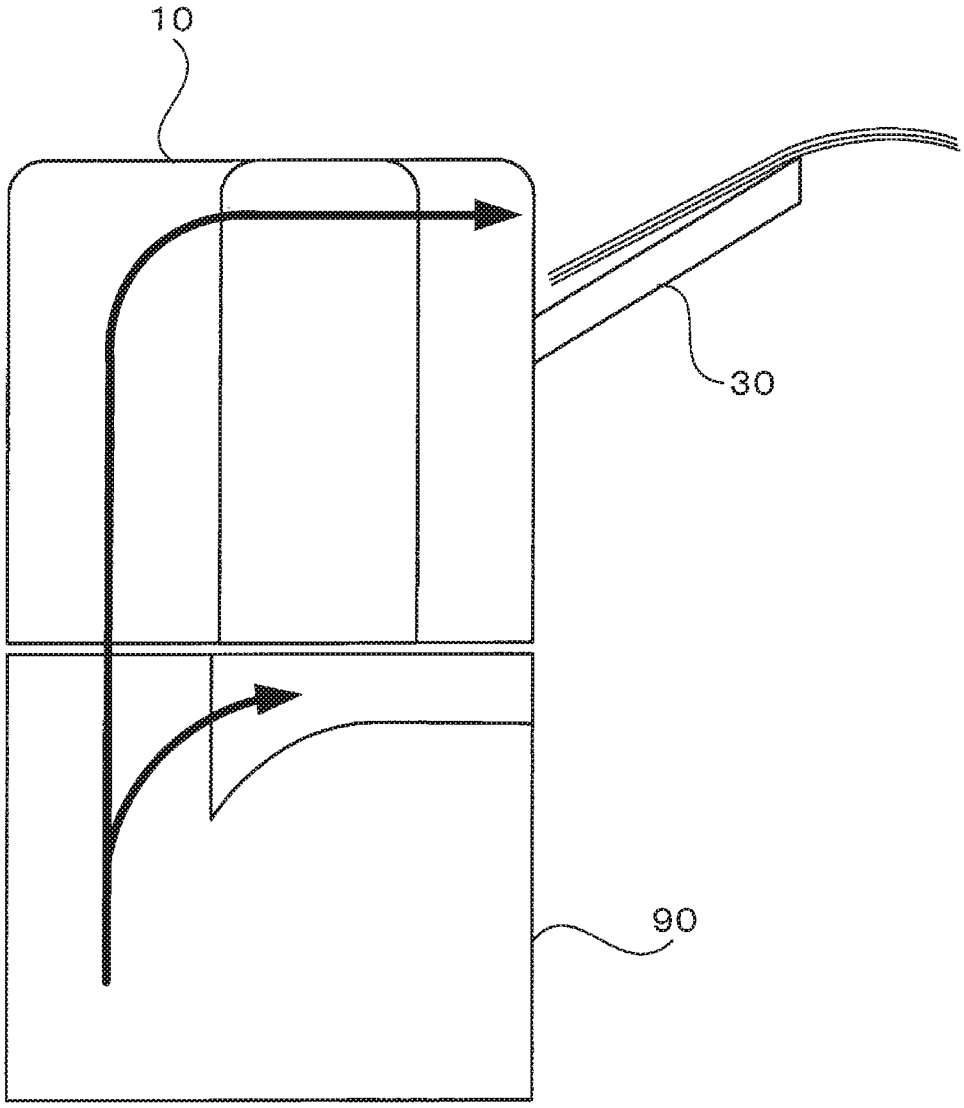
FIG. 2 is a diagram illustrating a state in which the post-processing apparatus according to the exemplary embodiment of the present invention is used by being connected to a printer.

FIG. 2 illustrates a state in which the post-processing apparatus 10 is used by being connected to a printer 90.

FIG. 2 illustrates a state in which the post-processing apparatus 10 ejects, to the ejection tray 30, a stack of printing sheets obtained by performing the post-processing, such as stapling, on printing sheets that are ejected from the printer 90 and introduced into the post-processing apparatus 10.

The configuration of the post-processing apparatus 10 according to the present exemplary embodiment for performing the post-processing on printing sheets and an ejecting operation that is to be performed after the post-processing has been performed will now be described.

Figure 3:
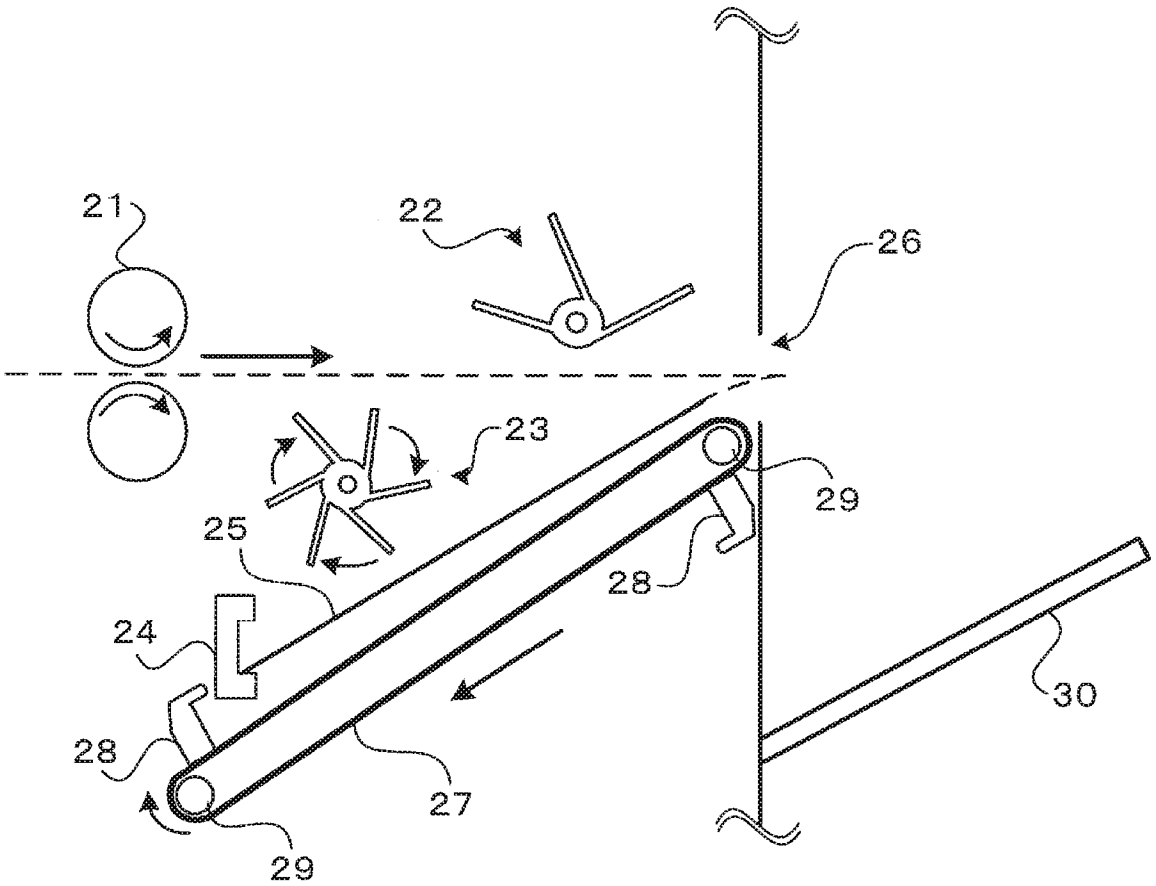
FIG. 3 is a schematic sectional view illustrating the configuration of a principal mechanism for performing post-processing in the post-processing apparatus according to the exemplary embodiment of the present invention.

FIG. 3 is a schematic sectional view illustrating the configuration of a principal mechanism for performing post-processing in the post-processing apparatus 10 according to the present exemplary embodiment. Note that FIG. 3 is a schematic sectional view illustrating an operation for ejecting a stack of printing sheets performed by the post-processing apparatus 10 and does not accurately illustrate the positional relationship in the actual configuration.

Referring to FIG. 3, the post-processing apparatus 10 according to the present exemplary embodiment includes transport rollers 21, sub-paddles 22, main paddles 23, an end guide 24, a compilation tray 25, an ejection port 26, ejection belts 27, stoppers 28, rotating rollers 29, and the ejection tray 30.

The transport rollers 21 transport printing sheets that are ejected from a printer or the like and on which post-processing is to be performed.

The compilation tray 25 is a storing unit that stores plural printing sheets for performing post-processing. A post-processing mechanism (not illustrated) performs post-processing such as, for example, stapling or punching on a stack of printing sheets stored in the compilation tray 25.

The main paddles 23 and the sub-paddles 22 are each formed so as to have the shape of a paddle (blade) having flexibility and are transport members that rotate to transport a printing sheet in a given direction.

The sub-paddles 22 transport a printing sheet transported from the upstream side of a transport path by the transport rollers 21 in a direction toward the compilation tray 25. More specifically, the sub-paddles 22 rotate while being in contact with a surface of a printing sheet to transport the printing sheet to the compilation tray 25.

The main paddles 23 keep transporting a printing sheet transported by the sub-paddles 22 further toward the compilation tray 25 until an end of the printing sheet reaches the end guide 24.

The end guide 24 is a sheet-aligning unit used for aligning the trailing end of a stack of printing sheets accommodated in the compilation tray 25.

A tamper (not illustrated) operates in accordance with the timing at which printing sheets reach the end guide 24, and as a result, alignment of a stack of the printing sheets on the compilation tray 25 in a width direction of the printing sheets is performed.

Each of the ejection belts 27 is an endless belt member and is stretched between a corresponding two of the rotating rollers 29.

Each of the stoppers 28 is a hook member that latches onto the trailing end of a stack of printing sheets. In addition, each of the stoppers 28 functions as a support member that supports a lower surface of a leading end portion of a printing sheet from below. A pair of the stoppers 28 are mounted on each of the ejection belts 27.

The ejection belts 27 are driven when ejecting a stack of printing sheets on which the post-processing has been performed. As a result of each of the ejection belts 27 being driven, the corresponding two stoppers 28 move while rotating by 180 degrees for each movement. Then, the stoppers 28 perform an operation for ejecting the stack of printing sheets, on which the post-processing has been performed in the compilation tray 25, from the ejection port 26 by latching onto (hooking onto) and pushing the trailing end of the stack of the printing sheets. The ejection belts 27 and the stoppers 28 function as pushing members that hook onto and push the trailing ends of the printing sheets stored in the compilation tray 25 toward the ejection port 26. The ejection belts 27 are driven in such a manner that stop positions of the stoppers 28 vary with the type of printing sheets on which the post-processing is to be performed. Details of performing control in such a manner that the stop positions of the stoppers 28 vary with the type of printing sheets will be described later. In the following description, the positions of the stoppers 28 that are illustrated in FIG. 3 will hereinafter be referred to as home positions. Here, the home positions refer to positions at which the stoppers 28 are accommodated in a body of the post-processing apparatus 10.

Figure 4:
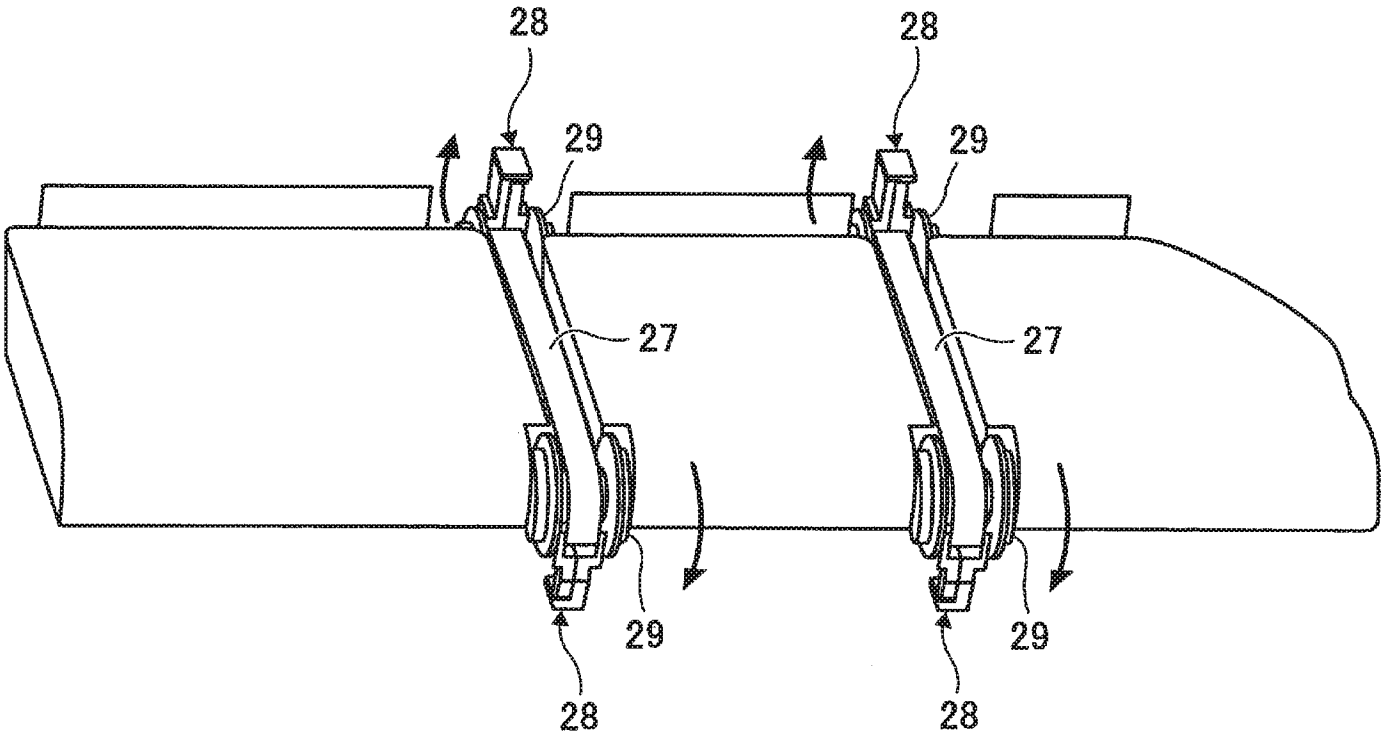
FIG. 4 is a perspective view illustrating a peripheral portion of stoppers in the post-processing apparatus according to the exemplary embodiment of the present invention.

FIG. 4 illustrates the peripheral structure of the stoppers 28 in the post-processing apparatus 10 according to the present exemplary embodiment.

FIG. 4 illustrates the two ejection belts 27 on which a corresponding two of the stoppers 28 are mounted.

Referring to FIG. 4, the rotating rollers 29, each of which is located on one end side of a corresponding one of the two ejection belts 27, are each driven by a motor (not illustrated) serving as a driving source for driving the corresponding ejection belt 27 so that the ejection belt 27 rotates. When the motors rotate, the rotating rollers 29 are driven, and the two ejection belts 27 rotate at the same time such that the stoppers 28 move in parallel with each other.

Figure 5:
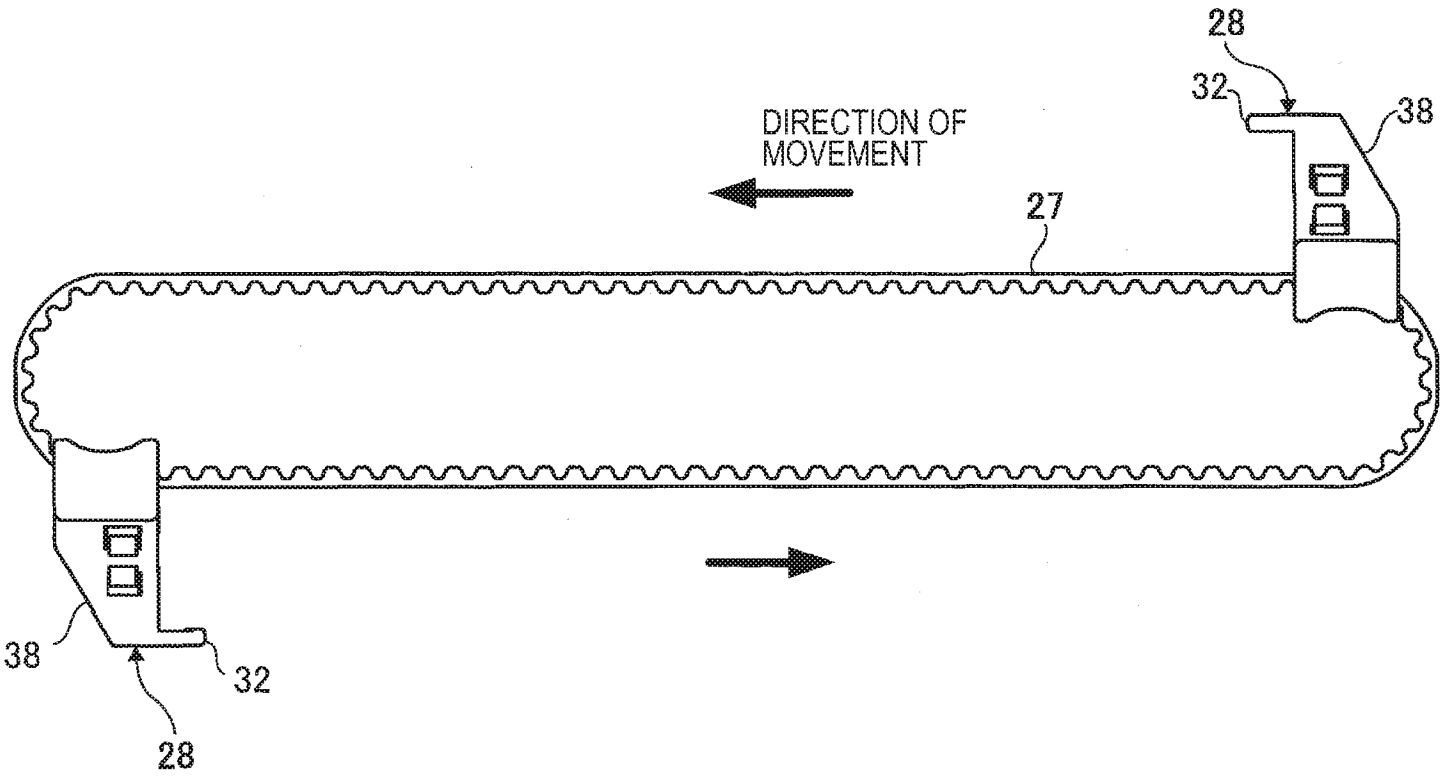
FIG. 5 is a diagram illustrating the state of the stoppers mounted on one of ejection belts in the configuration illustrated in FIG. 4.

FIG. 5 is illustrates a state in which two of the stoppers 28 are mounted on the corresponding ejection belt 27 in the configuration illustrated in FIG. 4.

A hook 32 is formed on a surface of each of the stoppers 28, the surface facing a direction of movement of the stopper 28. An inclined portion 38 is formed on a surface of each of the stoppers 28, the surface facing a direction opposite to the direction of movement of the stopper 28.

Each of the hooks 32 is formed at an end portion of the corresponding stopper 28 so as to project in the direction of movement of the stopper 28.

Each of the inclined portions 38 is formed in a side surface of the corresponding stopper 28, the side surface being opposite to a surface of the stopper 28 on which the corresponding hook 32 is formed. In a state where the stoppers 28 are mounted on the ejection belt 27, each of the inclined portions 38 is formed so as to be inclined from the side on which the ejection belt 27 is present toward the side on which the corresponding hook 32 is present in the direction of movement of the stopper 28.

In other words, each of the stoppers 28 is configured to latch onto the trailing end of a stack of printing sheets on the compilation tray 25 by using the hooks 32 and push the stack of printing sheets toward the ejection port 26. Each of the stoppers 28 is configured to support the leading end of a printing sheet, which is to be transported to the compilation tray 25, from the side on which the inclined portion 38 thereof is present in accordance with the type (thickness) of the printing sheet, and the trailing end of the printing sheet supported by the stopper 28 falls onto the compilation tray 25 and is drawn in by the main paddles 23 so as to be further transported toward the compilation tray 25.

Each of the stoppers 28 according to the present exemplary embodiment is detachable from the corresponding ejection belt 27, and when the stopper 28 is required to be replaced due to, for example, deterioration thereof, the stopper 28 may be easily replaced. In addition, each of the stoppers 28 is capable of being mounted on a versatile belt member.

Each of the ejection belts 27 is formed of, for example, an elastic member made of an elastic rubber or the like, which is a material such as ethylene propylene diene monomer (EPDM) rubber having a high elastic limit and a low modulus of elasticity. Each of the stoppers 28 is formed of, for example, a member made of a resin.

Figure 6:
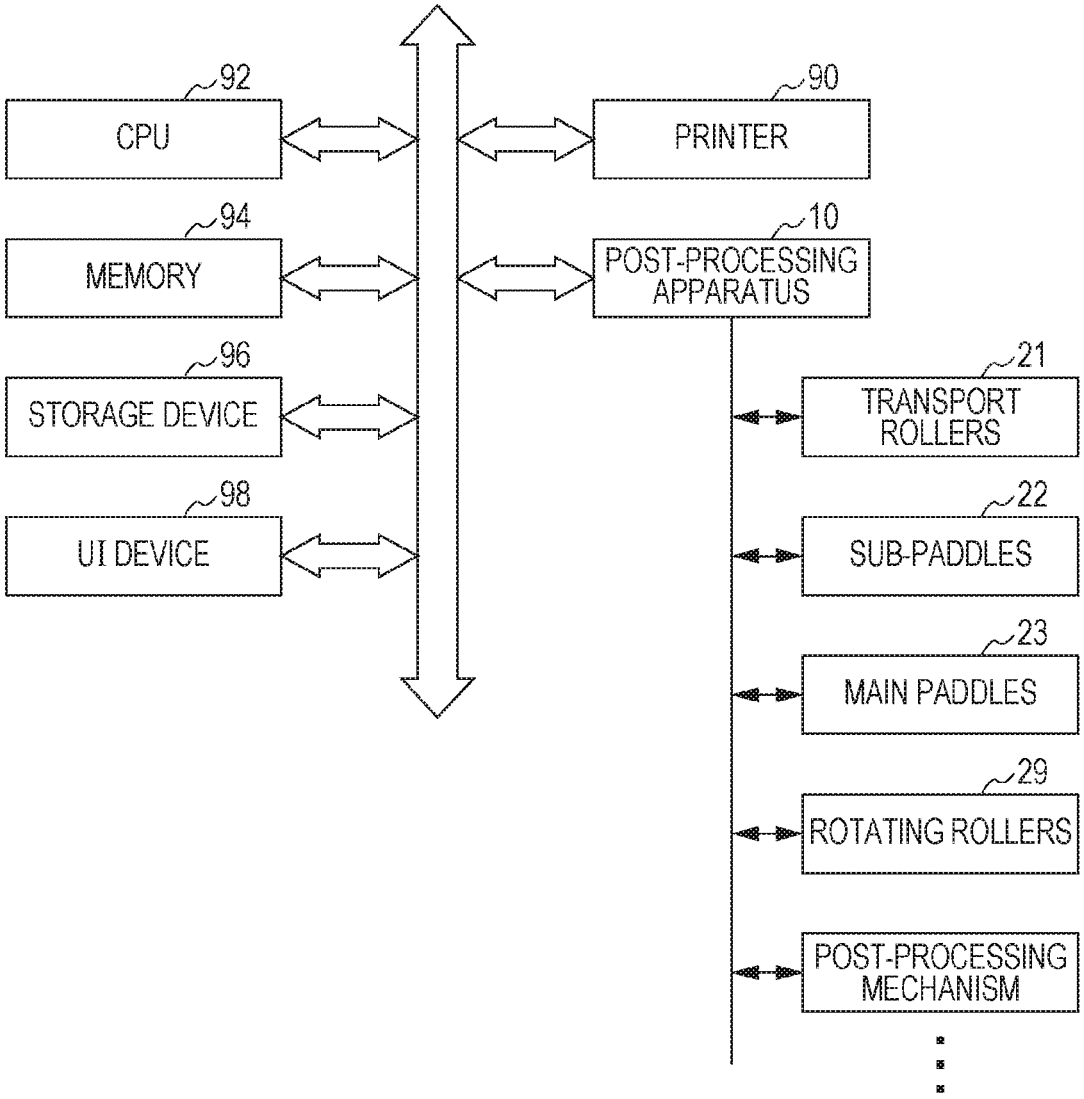
FIG. 6 is a block diagram illustrating a control configuration of the post-processing apparatus according to the exemplary embodiment of the present invention.

FIG. 6 is a block diagram illustrating a control configuration of the post-processing apparatus 10.

As illustrated in FIG. 6, the above-mentioned printer 90, a central processing unit (CPU) 92, a memory 94, a storage device 96, and a user interface (UI) device 98 are connected to the post-processing apparatus 10 via a bus.

The transport rollers 21, the sub-paddles 22, the main paddles 23, the rotating rollers 29, the post-processing mechanism, and the like are controlled among the components included in the post-processing apparatus 10.

The CPU 92 controls the operation of the post-processing apparatus 10 and the operation of the printer 90 by running programs written in the memory 94 or the storage device 96. An input received via the UI device 98 is transmitted to the CPU 92, and display information is transmitted from the CPU 92 to the UI device 98.

Note that the CPU 92 may run programs stored in a transportable storage medium, such as a compact disc read-only memory (CD-ROM), which is not illustrated, or may run programs provided via a communication device, which is not illustrated.

The storage device 96 stores information related to the type of a recording medium such as the basis weight (thickness (weight)) of a sheet. For example, a hard disk drive or the like is used as the storage device 96, and the storage device 96 stores data in a writable and readable manner.

The operation of the post-processing apparatus 10 according to the present exemplary embodiment will now be described with reference to FIG. 7 to FIG. 16. FIG. 7 to FIG. 16 are diagrams each illustrating an operation for performing the post-processing on a printing sheet P, which is a thick sheet, by using the post-processing apparatus 10 according to the present exemplary embodiment. Here, the thick sheet refers to a sheet having a basis weight of, for example, 150 $g/m^2$ or greater. Note that the basis weight of a normal sheet is about 64 $g/m^2$ to about 68 $g/m^2$.

Figure 7:
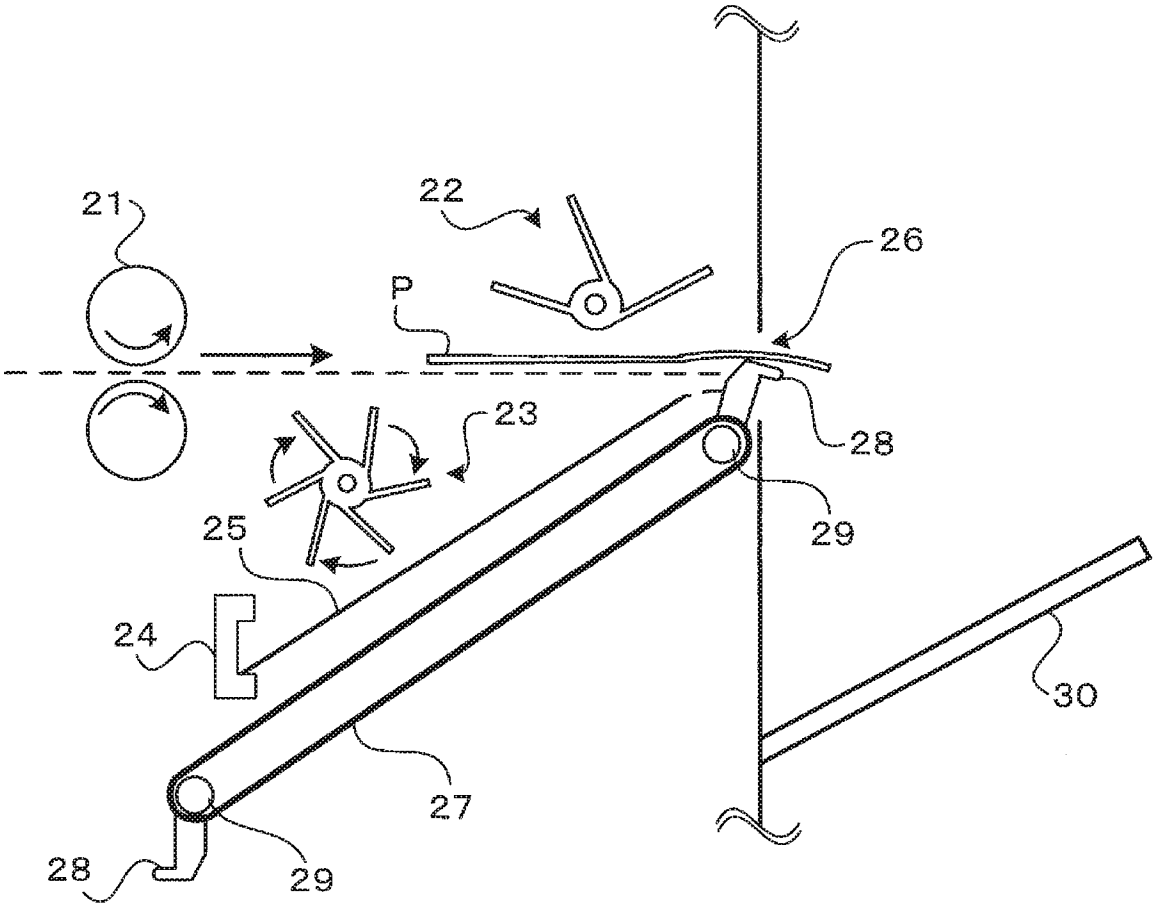
FIG. 7 is a diagram illustrating operation of the post-processing apparatus according to the exemplary embodiment of the present invention.

First, in an initial state, blades of the sub-paddles 22 are stationary at positions at which the blades face away from a sheet transport path as illustrated in FIG. 7.

Thus, as illustrated in FIG. 7, the printing sheet P transported by the transport rollers 21 passes under the sub-paddles 22 without being hindered and then stops.

In this case, two of the stoppers 28 are stationary at positions in the vicinity of a highest portion of the compilation tray 25 and support a lower surface of a leading end portion of the printing sheet P. Thus, as illustrated in FIG. 8, the trailing end of the printing sheet P falls onto the compilation tray 25.

Figure 8:
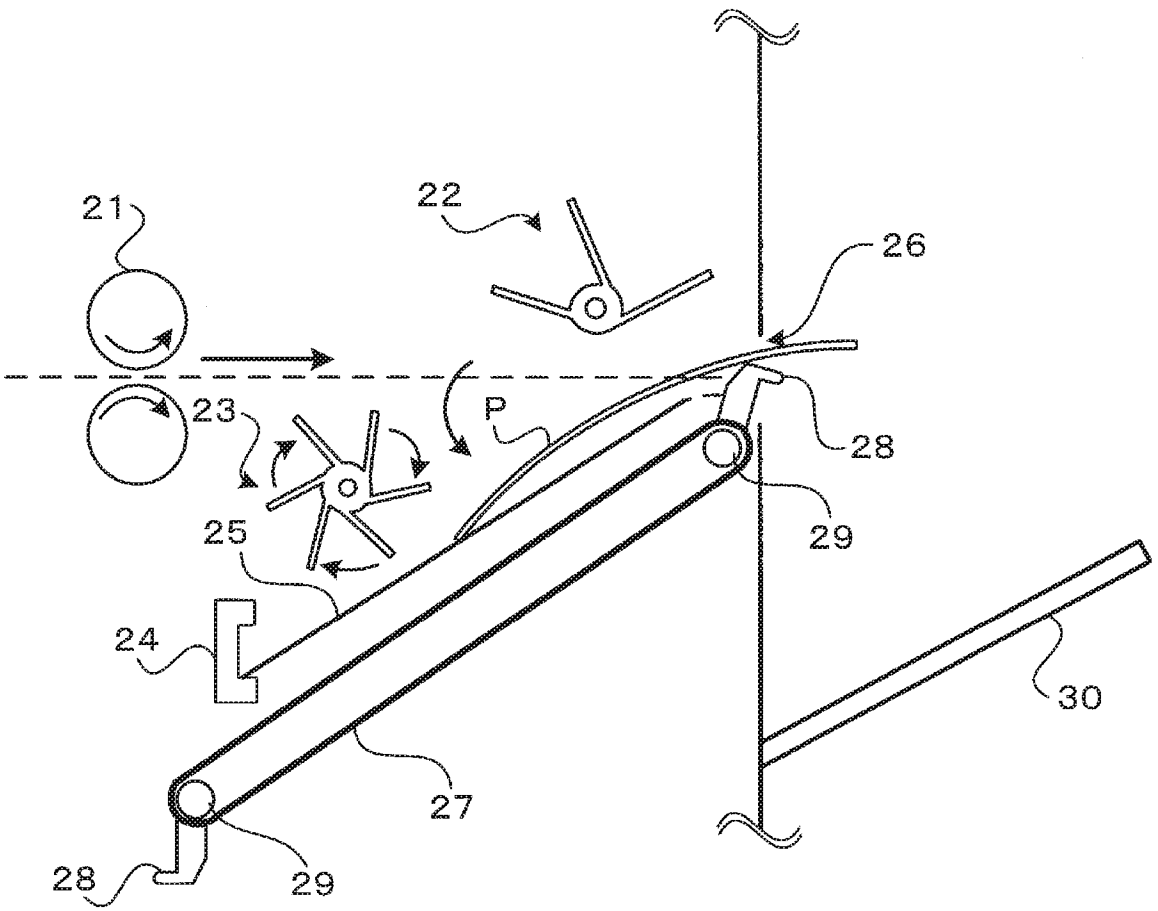
FIG. 8 is a diagram illustrating operation of the post-processing apparatus according to the exemplary embodiment of the present invention.
Figure 9:
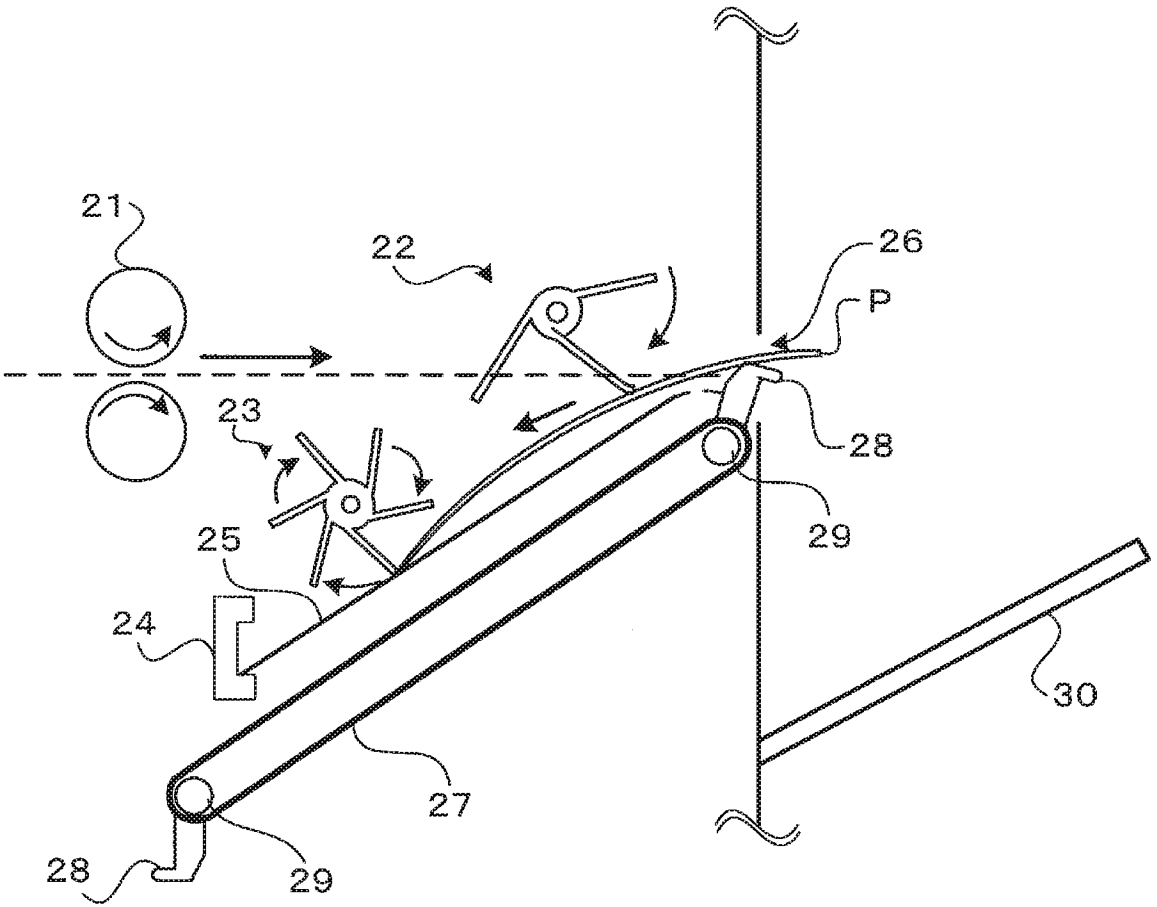
FIG. 9 is a diagram illustrating operation of the post-processing apparatus according to the exemplary embodiment of the present invention.
Figure 10:
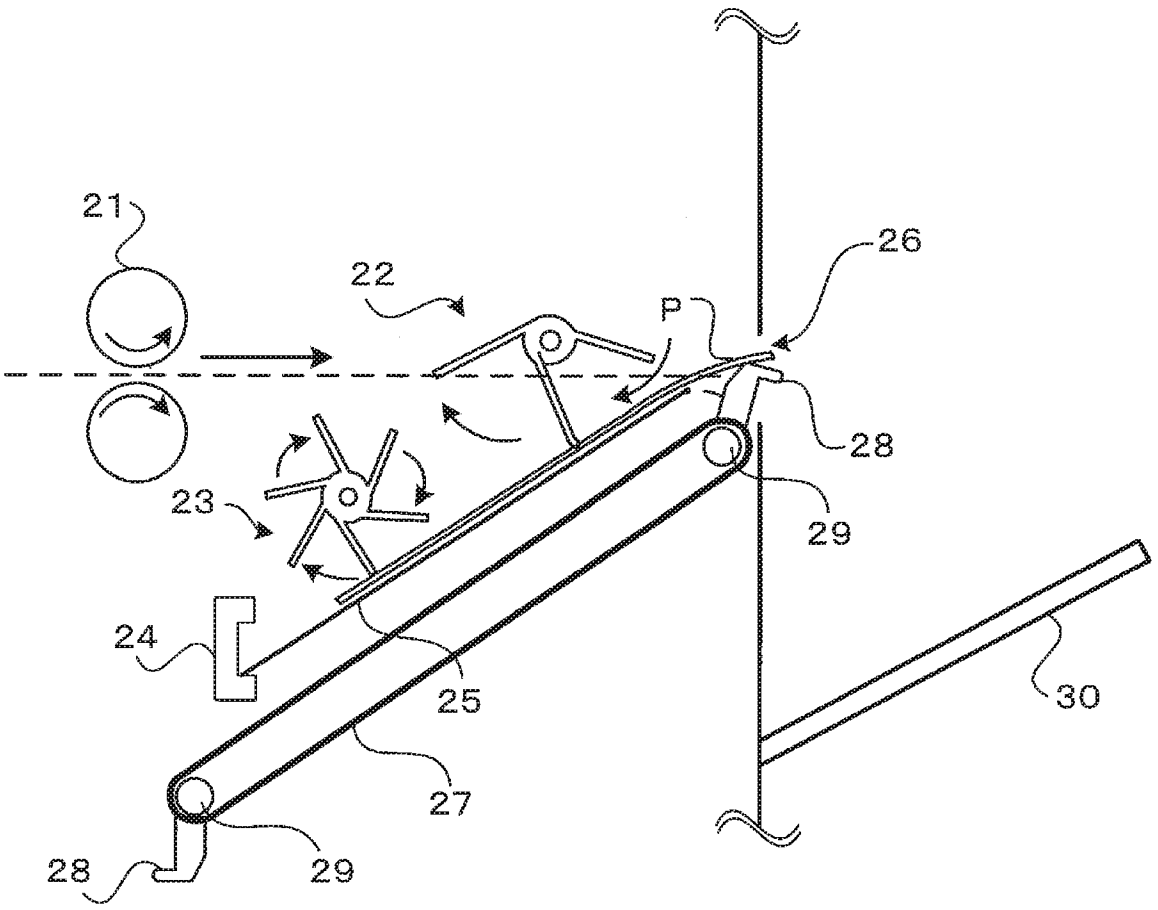
FIG. 10 is a diagram illustrating operation of the post-processing apparatus according to the exemplary embodiment of the present invention.

In the state illustrated in FIG. 8, when power is supplied to the motors so as to cause the sub-paddles 22 to start rotating, as illustrated in FIG. 9, the sub-paddles 22 are brought into contact with the printing sheet P, and the printing sheet P is transported. Then, as illustrated in FIG. 10, the printing sheet P is brought into contact with the main paddles 23 and transported until the printing sheet P abuts against the end guide 24.

Figure 11:
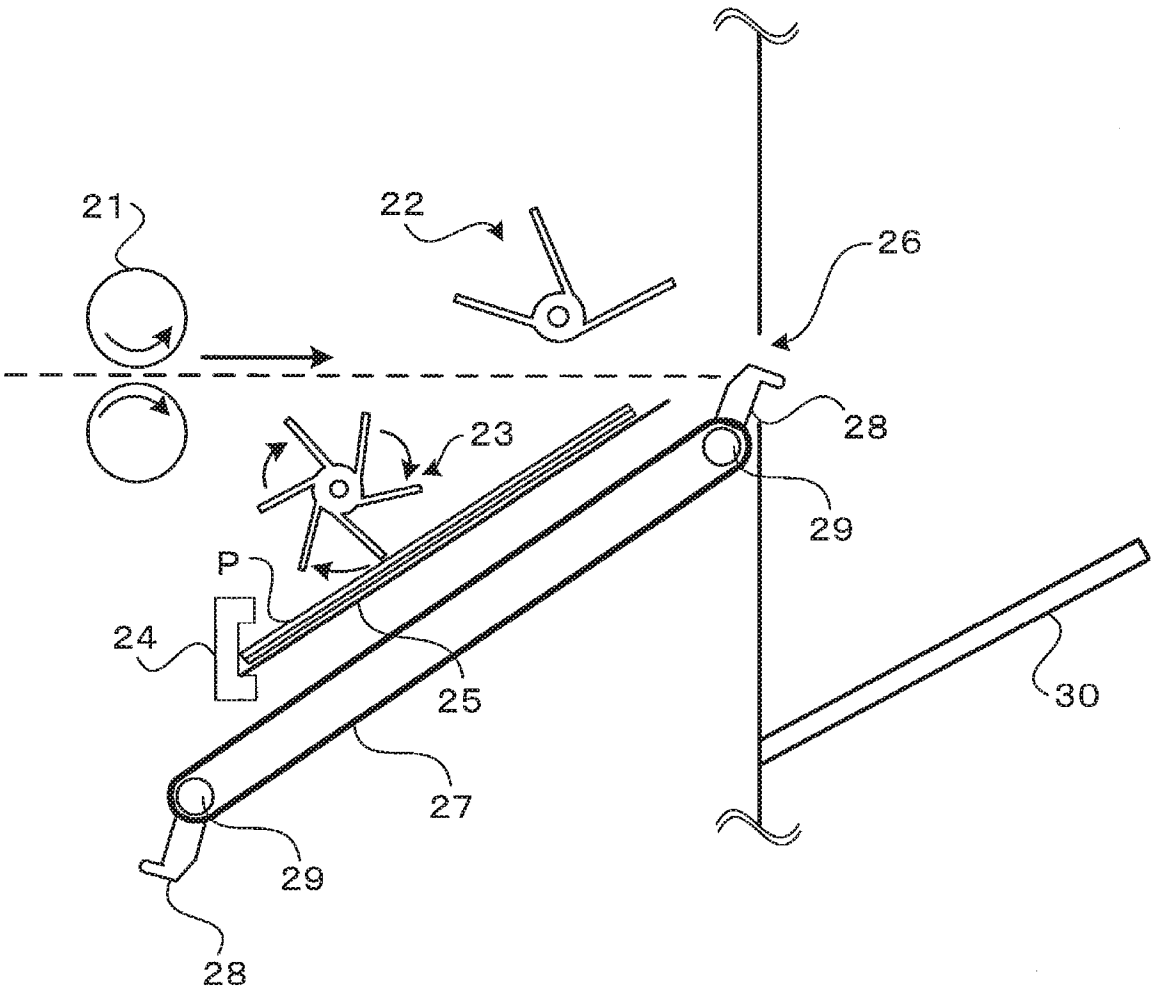
FIG. 11 is a diagram illustrating operation of the post-processing apparatus according to the exemplary embodiment of the present invention.

Subsequently, when the next printing sheet P is transported by the transport rollers 21, an operation similar to the above is performed, and a predetermined number of printing sheets P are accommodated in the compilation tray 25 as illustrated in FIG. 11. After the printing sheets P have been accommodated in the compilation tray 25, each of the motors is brought into a non-operating state, and each of the sub-paddles 22 is caused, by a spring, to stop at a stop position at which the sub-paddle 22 does not hinder the passage of the printing sheets P.

Figure 12:
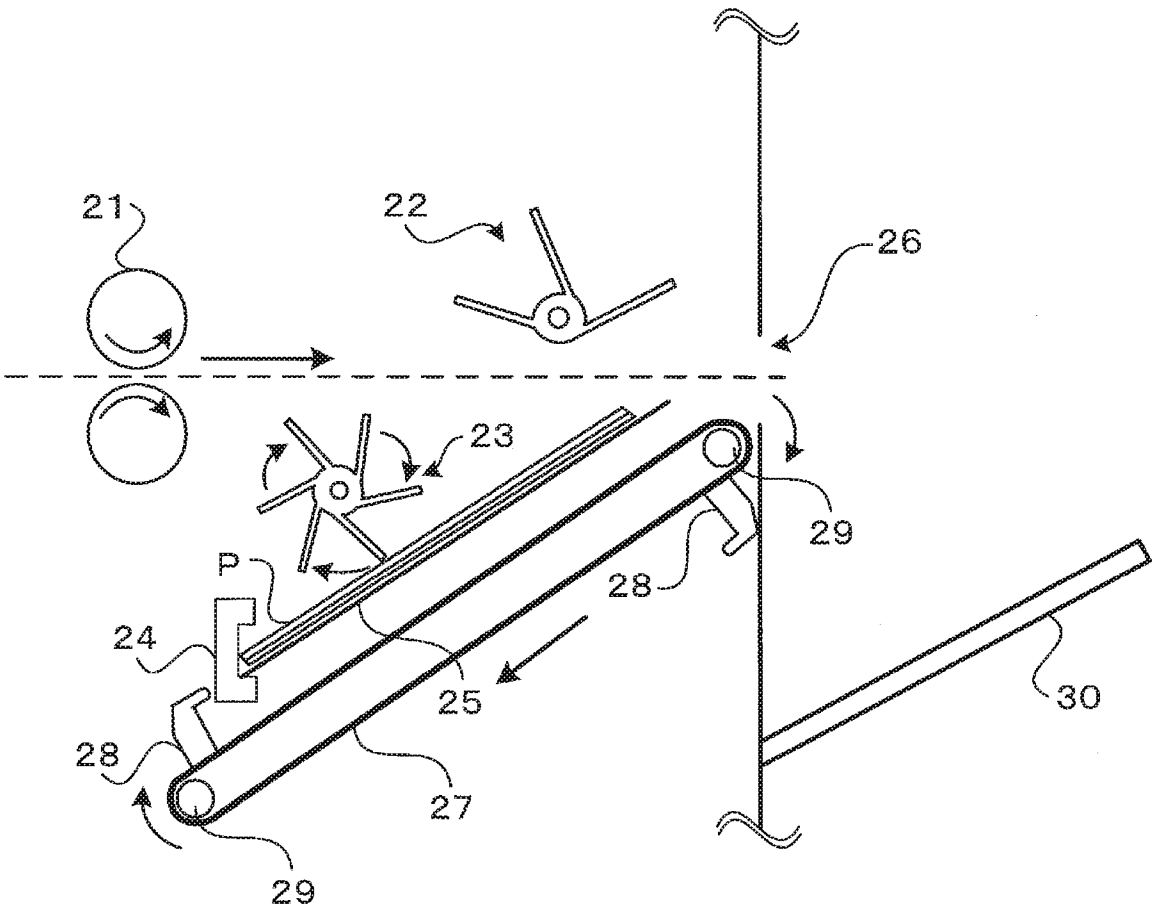
FIG. 12 is a diagram illustrating operation of the post-processing apparatus according to the exemplary embodiment of the present invention.
Figure 13:
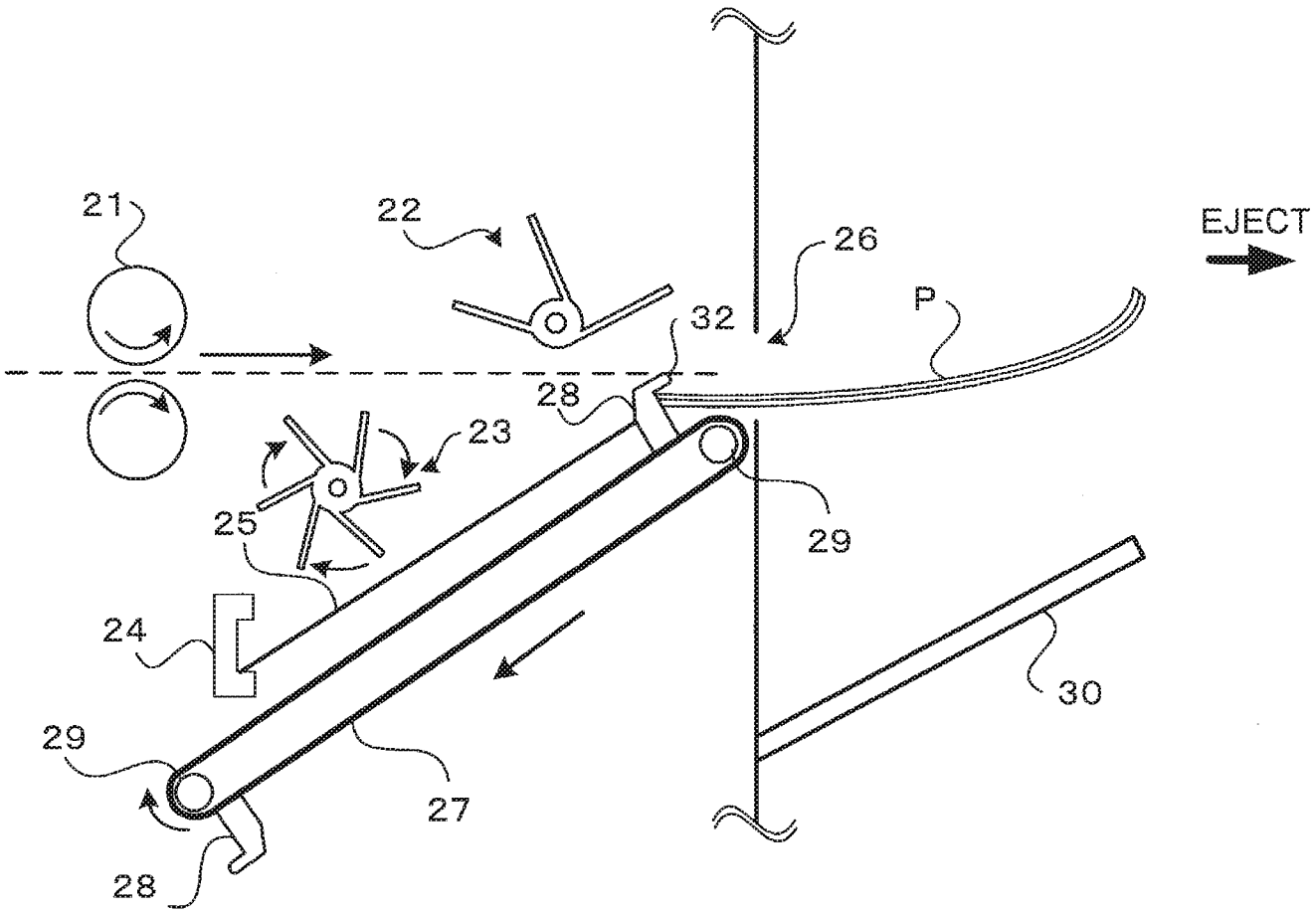
FIG. 13 is a diagram illustrating operation of the post-processing apparatus according to the exemplary embodiment of the present invention.
Figure 14:
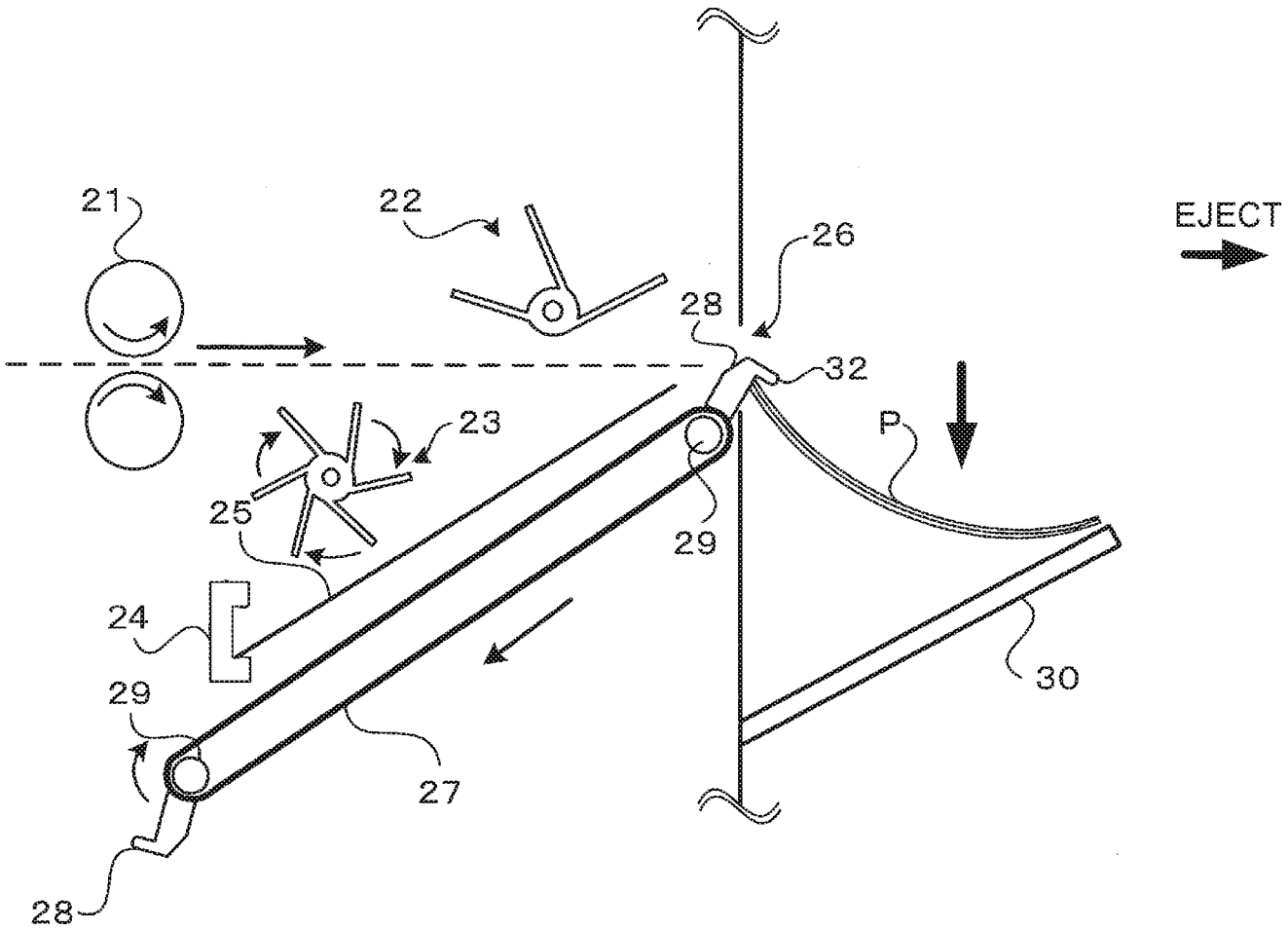
FIG. 14 is a diagram illustrating operation of the post-processing apparatus according to the exemplary embodiment of the present invention.
Figure 15:
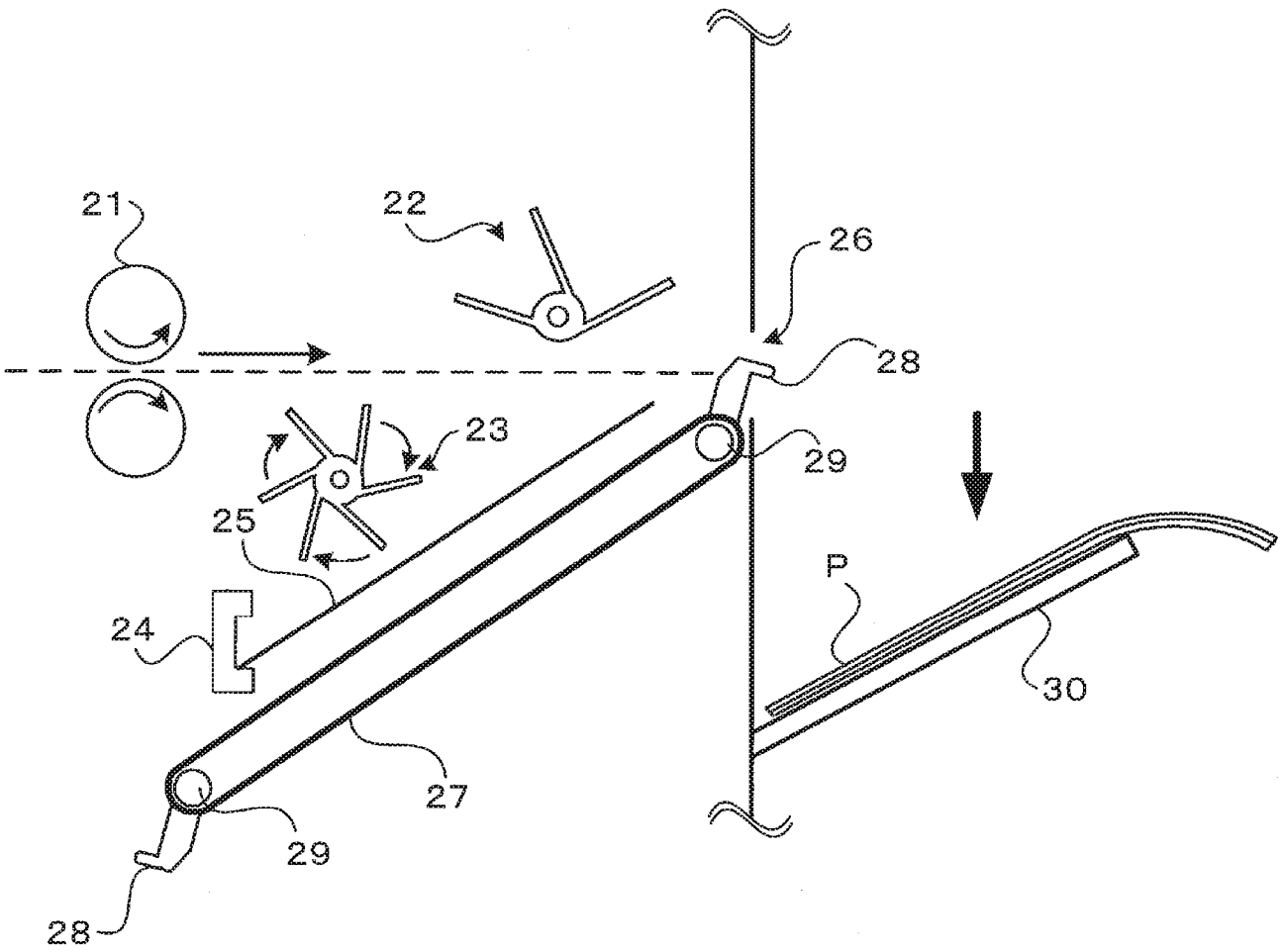
FIG. 15 is a diagram illustrating operation of the post-processing apparatus according to the exemplary embodiment of the present invention.

After the post-processing has been performed on the stack of printing sheets P, as illustrated in FIG. 12, each of the ejection belts 27 is driven by the driving source (not illustrated). Then, as illustrated in FIG. 13, the hooks 32 of the stoppers 28 latch onto and push the trailing end of the stack of printing sheets P, on which the post-processing has been performed, and the stoppers 28 stop at the positions in the vicinity of the highest portion of the compilation tray 25 as illustrated in FIG. 14. The stack of printing sheets P, on which the post-processing has been performed, is ejected from the ejection port 26. As a result, as illustrated in FIG. 15, the stack of the printing sheets P, which has been ejected, falls onto the ejection tray 30.

Figure 16:
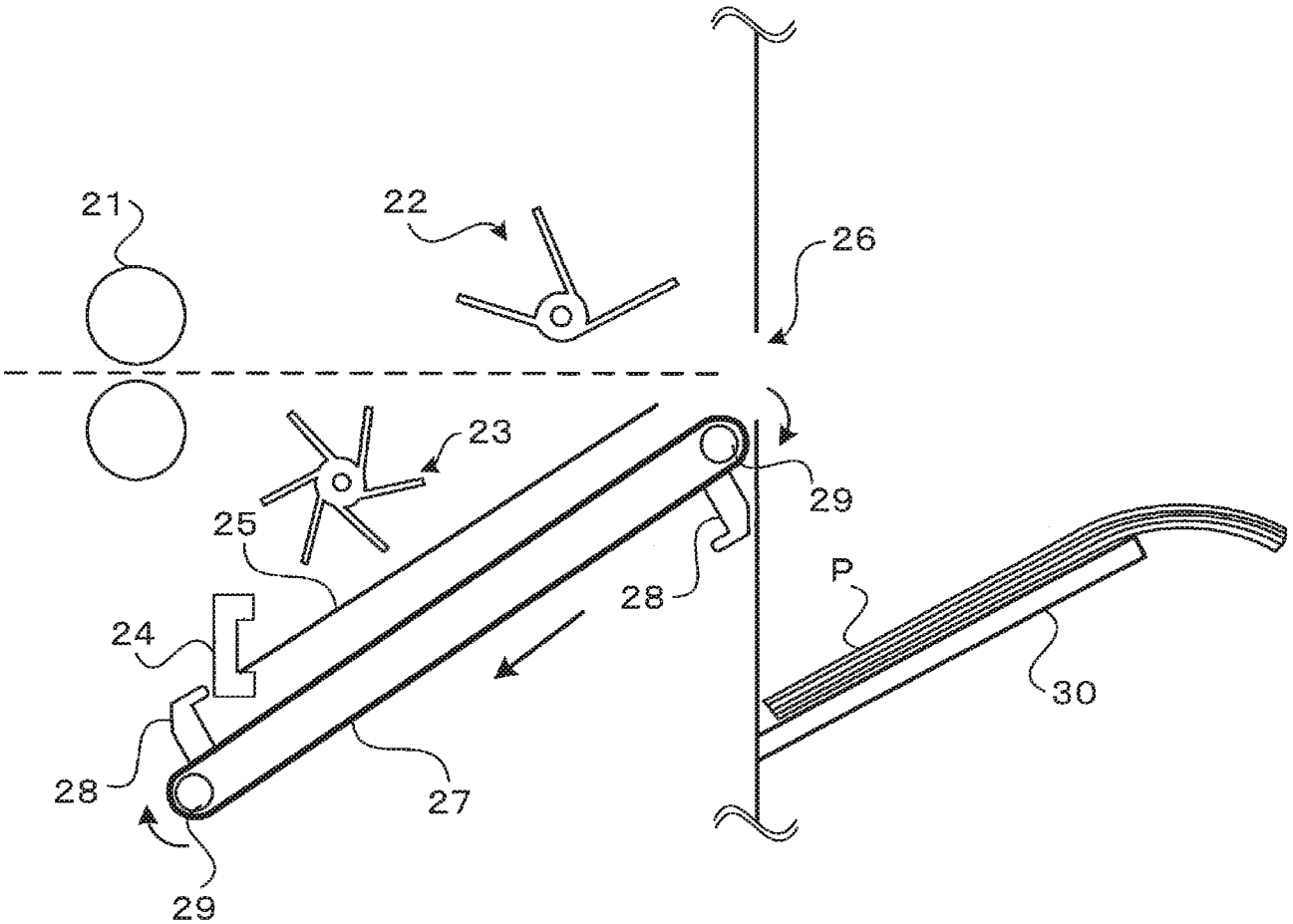
FIG. 16 is a diagram illustrating operation of the post-processing apparatus according to the exemplary embodiment of the present invention.

By performing control such as that described above, a stack of printing sheets obtained by performing the post-processing on plural printing sheets, on each of which a printing operation has been performed, is ejected to the ejection tray 30. When processing based on a single execution instruction is complete, the stoppers 28 move to their home positions and stop as illustrated in FIG. 16.

Here, different types of printing sheets have different thicknesses. When a thick sheet, a highly resilient sheet, a downwardly curled sheet, or the like (hereinafter referred to as a thick sheet or the like) is used as a printing sheet, there is a case where the vertical position of the leading end of the printing sheet becomes lower while the vertical position of the trailing end of the printing sheet does not, and as a result, the printing sheet will not be accommodated in the compilation tray 25.

Figure 17:
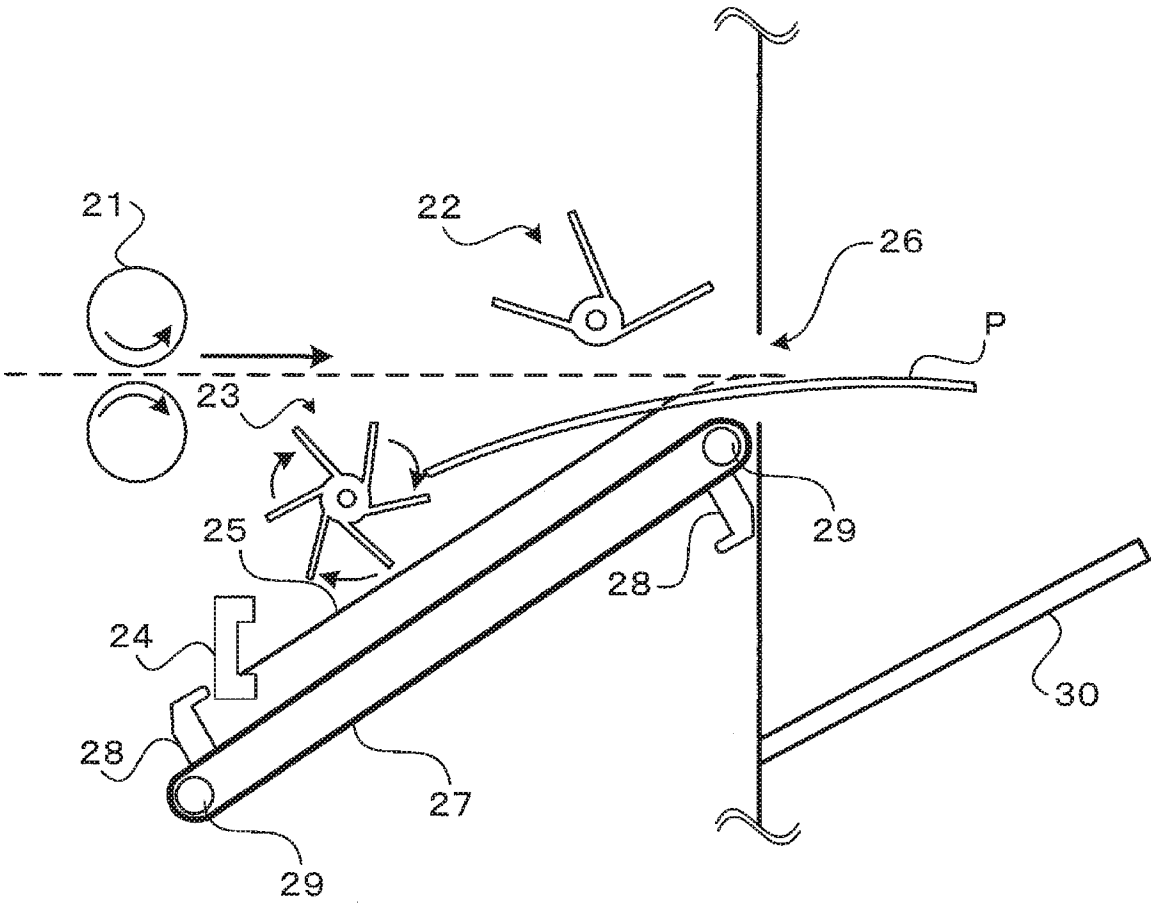
FIG. 17 is a diagram illustrating operation of a post-processing apparatus according to a comparative example.
Figure 18:
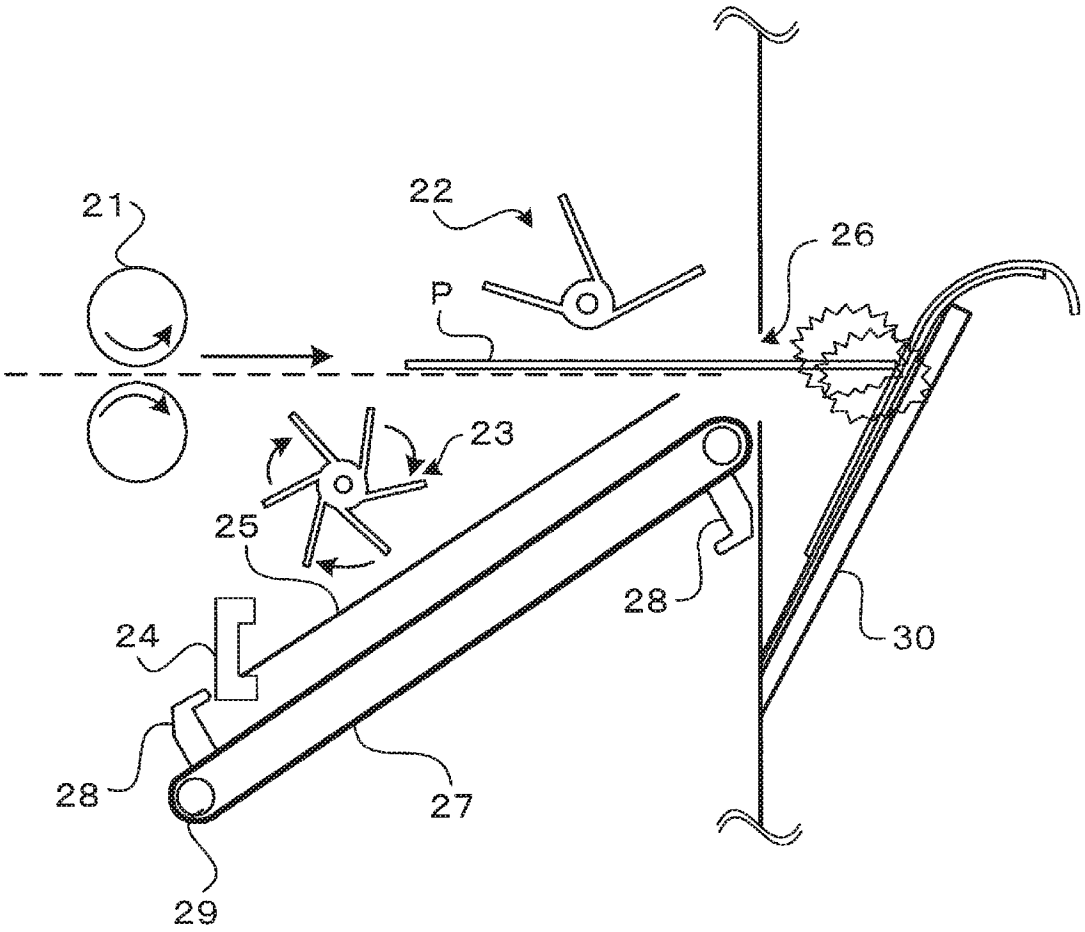
FIG. 18 is a diagram illustrating operation of the post-processing apparatus according to the comparative example.

FIG. 17 is a diagram illustrating a state in which a thick sheet is transported while the stop positions of the stoppers 28 are located at the home positions, and FIG. 18 is a diagram illustrating a state in which a thick sheet is transported while the stop positions of the stoppers 28 are located at the home positions and in which the angle of the ejection tray 30 has been changed.

As illustrated in FIG. 17, especially when transporting a printing sheet such as a thick sheet or the like toward the compilation tray 25 that is short in length in a transport direction, there is a case where the vertical position of the leading end of the printing sheet becomes lower while the vertical position of the trailing end of the printing sheet becomes higher, and as a result, the printing sheet will not be transported toward the compilation tray 25 as a result of rotation of the main paddles 23.

In order to prevent the vertical position of the leading end of a printing sheet, such as a thick sheet or the like, from becoming lower, if the angle of the ejection tray 30 is increased as illustrated in FIG. 18, there is a possibility that the printing sheet that is subsequently transported will displace printing sheets on the ejection tray 30 by pushing against them, which in turn leads to a sheet alignment failure on the ejection tray 30.

When the friction coefficient of rubber included in the paddles is decreased due to physical properties of sheets and wear and tear of the paddles, the force that draws in a sheet is also decreased. If the transport force of the paddles is too large, there is a possibility that a secondary problem such as buckling will occur. Regarding physical properties of the sheets, in the case of a coated sheet, a copy sheet, or the like, a calcium carbonate component adheres to the paddles and causes a decrease in the friction coefficient of the rubber included in the paddles. Since a thick sheet or the like is heavy, a sheet-aligning operation may be mechanistically performed with a small transport force on the compilation tray 25 rather than increasing a sheet transport force.

Accordingly, in the post-processing apparatus 10 according to the present exemplary embodiment, control is performed such that the trailing ends of printing sheets to be accommodated in the compilation tray 25 are stabilized so as to be easily aligned by lifting the leading ends of the printing sheets in accordance with the type of the printing sheets such as the thicknesses of the printing sheets, and as a result, a sheet accommodation failure is prevented from occurring in the compilation tray 25.

Figure 19:
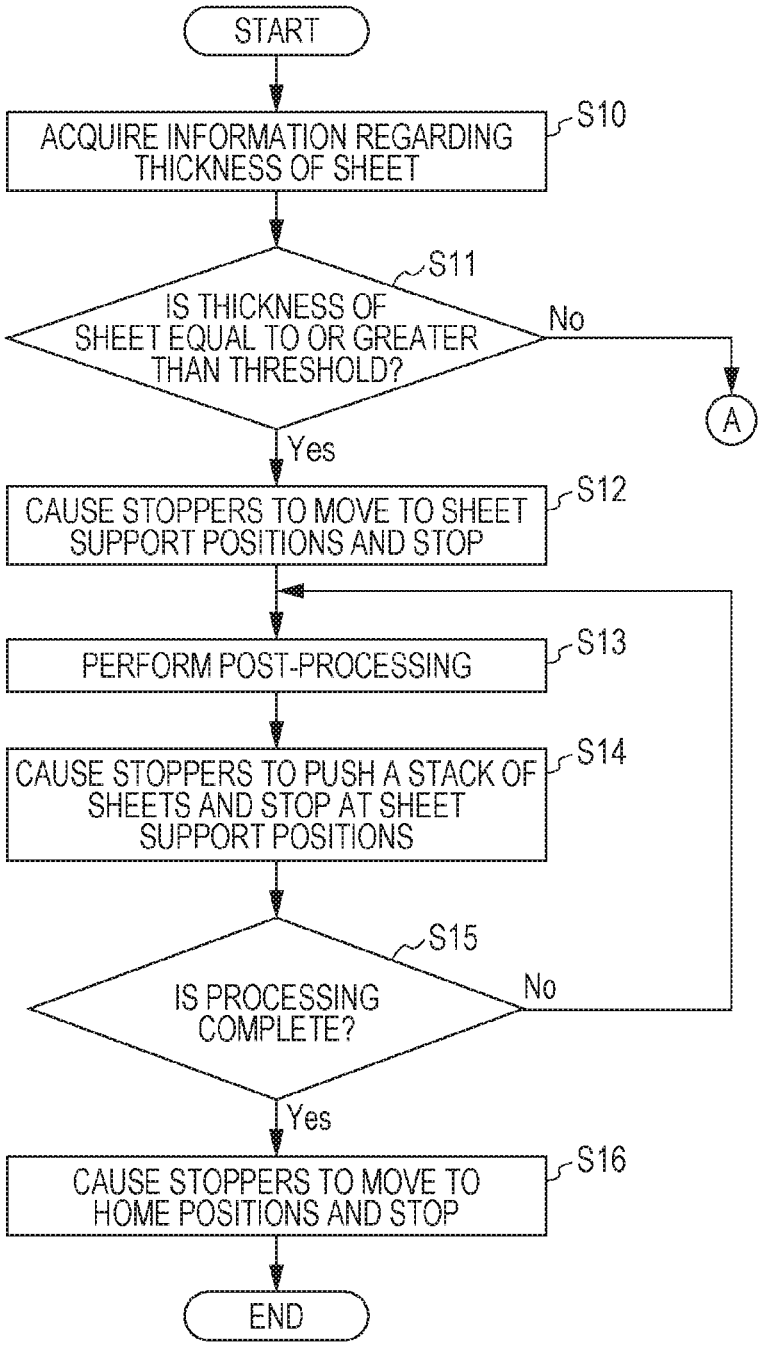
FIG. 19 is a flowchart illustrating operation of the post-processing apparatus according to the exemplary embodiment of the present invention.
Figure 20:
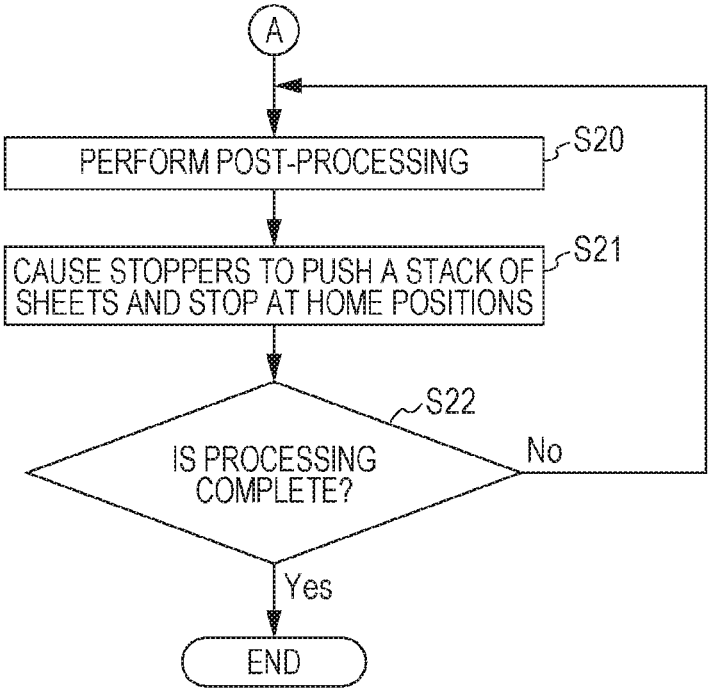
FIG. 20 is a flowchart illustrating operation of the post-processing apparatus according to the exemplary embodiment of the present invention.
Figure 21A:
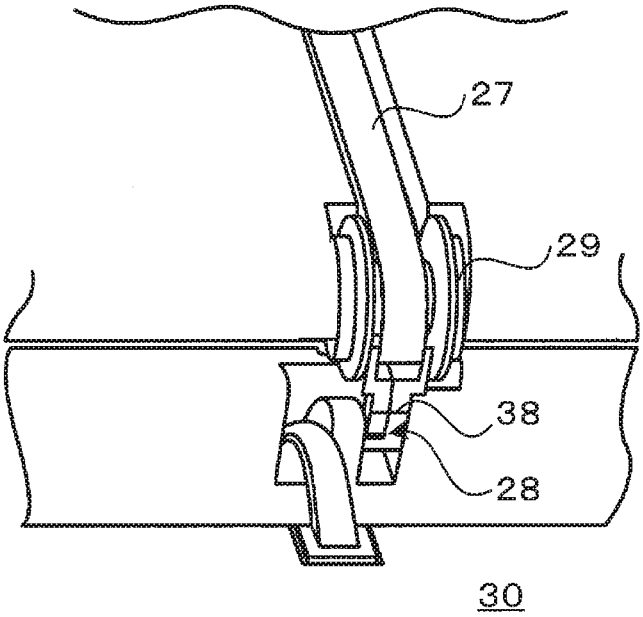
FIG. 21A is a perspective view illustrating a standby position of one of the stoppers when a normal sheet is subjected to processing.
Figure 21B:
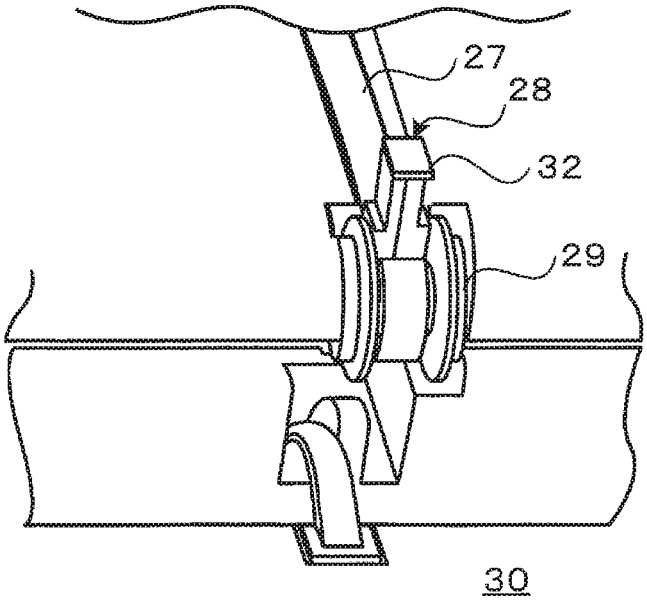
FIG. 21B is a perspective view illustrating a standby position of the one of the stoppers when a thick sheet is subjected to processing.
Figure 22A:
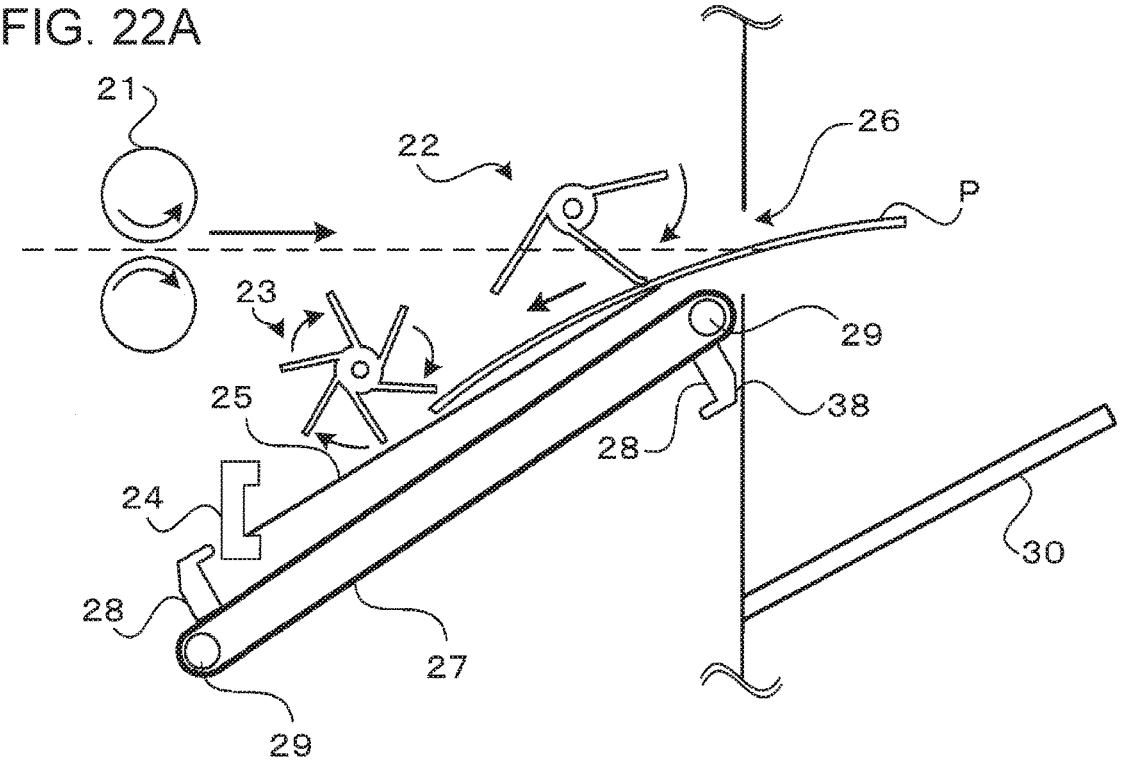
FIG. 22A is a schematic sectional view illustrating standby positions of the stoppers when a normal sheet is subjected to processing.
Figure 22B:
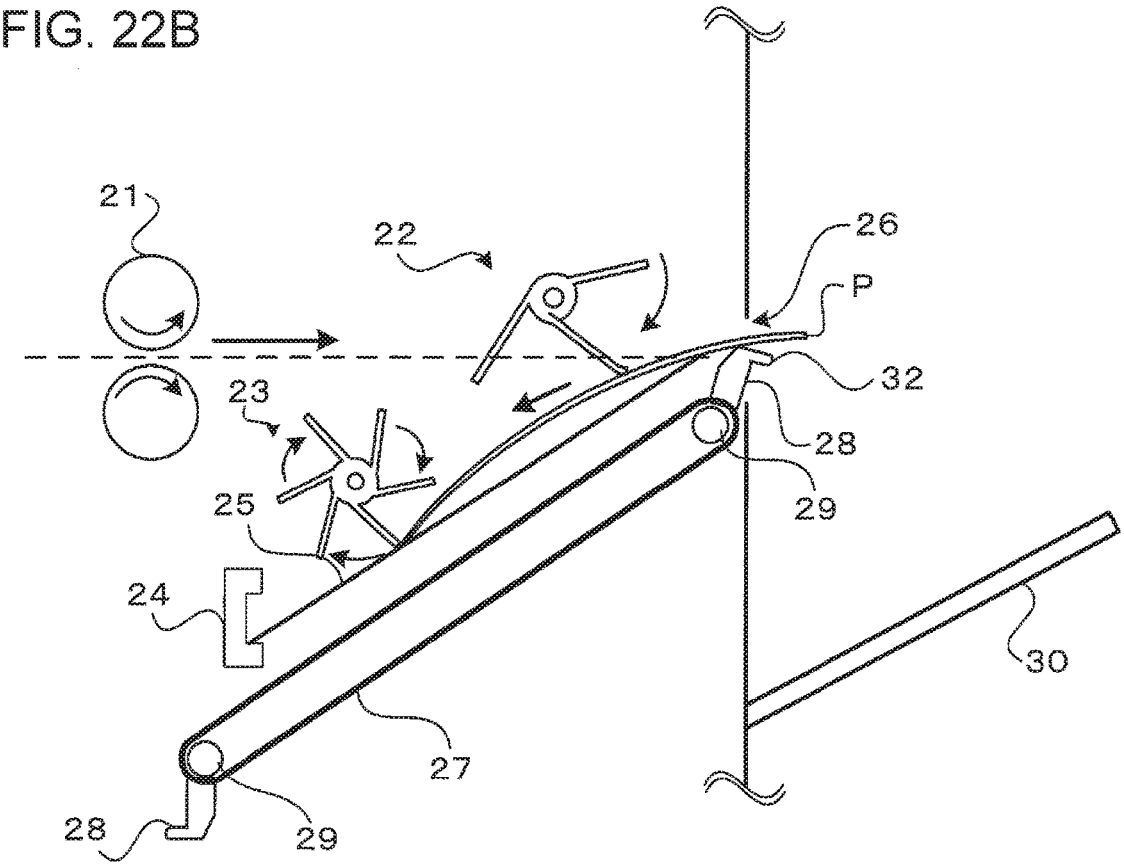
FIG. 22B is a schematic sectional view illustrating standby positions of the stoppers when a thick sheet is subjected to processing.

Exemplary operation of the post-processing apparatus 10 according to the present exemplary embodiment will now be described. FIG. 19 and FIG. 20 are flowcharts each illustrating operation of the post-processing apparatus 10 according to the present exemplary embodiment. FIG. 21A is a perspective view illustrating the stop position (home position) of one of the stoppers 28 when a normal sheet is subjected to processing, and FIG. 21B is a perspective view illustrating the stop position of the stopper 28 when a thick sheet is subjected to processing. FIG. 22A is a schematic sectional view illustrating the stop positions (home positions) of two of the stoppers 28 when a normal sheet is subjected to processing, and FIG. 22B is a schematic sectional view illustrating the stop positions of the stoppers 28 when a thick sheet is subjected to processing. Note that, when starting the processing, the stoppers 28 are stationary at their home positions.

First, the CPU 92 acquires information regarding the thickness of one of the printing sheets P from the storage device 96 (step S10).

Next, the CPU 92 determines, on the basis of the acquired information regarding the thickness of the printing sheet P, whether the thickness of the printing sheet P to be transported to the post-processing apparatus 10 is equal to or greater than a predetermined threshold, which is, for example, a basis weight of 150 g/m$^2$ (step S11).

In the case where the CPU 92 determines that the thickness of the printing sheet P is equal to or greater than the predetermined threshold (Yes in step S11), the CPU 92 performs control such that the rotating rollers 29 are driven and that two of the stoppers 28 move to and stop at the positions at which the stoppers 28 support the leading end of the printing sheet P, the positions being located in the vicinity of the highest portion of the compilation tray 25 as illustrated in FIG. 21B and FIG. 22B (step S12).

Then, as illustrated in FIG. 22B, when the trailing end of the thick sheet falls onto the compilation tray 25, the CPU 92 drives the sub-paddles 22 and the main paddles 23. As a result, the thick sheet is transported toward the end guide 24, and a predetermined number of printing sheets P are accommodated in the compilation tray 25, after which the post-processing is performed on a stack of the printing sheets P (step S13).

Subsequently, the CPU 92 causes the stoppers 28 to move and push the trailing end of the stack of the printing sheets P toward the ejection port 26 and controls the stoppers 28 so as to stop at positions at which the stoppers 28 support the printing sheets P (step S14).

Then, the CPU 92 determines whether a series of processes has ended (step S15). If the CPU 92 determines that the series of processes has not ended (No in step S15), the process returns to step S13.

If the CPU 92 determines that the series of processes has ended (Yes in step S15), the CPU 92 controls the stoppers 28 so as to move to and stop at their home positions (step S16).

In the case where the CPU 92 determines that the thickness of the printing sheet P is less than the predetermined threshold (No in step S11), as illustrated in FIG. 22A, when the trailing end of the normal sheet falls onto the compilation tray 25, the CPU 92 drives the sub-paddles 22 and the main paddles 23. As a result, the normal sheet is transported toward the end guide 24, and a predetermined number of printing sheets P are accommodated in the compilation tray 25, after which the post-processing is performed on a stack of the printing sheets P (step S20).

Subsequently, the CPU 92 causes the stoppers 28 to move and push the trailing end of the stack of the printing sheets P toward the ejection port 26 and controls the stoppers 28 so as to stop at their home positions (step S21).

After that, the CPU 92 determines whether a series of processes has ended (step S22). If the CPU 92 determines that the series of processes has not ended (No in step S22), the process returns to step S20. If the CPU 92 determines that the series of processes has ended (Yes in step S22), the CPU 92 ends the process.

In other words, control is performed such that the trailing end of the printing sheet P falls onto the compilation tray 25 and that the printing sheet P is transported toward the end guide 24 as a result of rotations of the sub-paddles 22 and the main paddles 23 so as to be accommodated in the compilation tray 25 in the state illustrated in FIG. 22A when the printing sheet P is a normal sheet and in the state illustrated in FIG. 22B when the printing sheet P is a thick sheet.

[Modifications]

Note that, in the above exemplary embodiment, although a configuration has been described in which the stoppers are controlled so as to move to and stop at positions at which the stoppers support a printing sheet when the thickness of the printing sheet is equal to or greater than a predetermined threshold, the present invention is not limited to this configuration, and the stoppers may be controlled so as to be always stationary at the positions at which the stoppers support a printing sheet during the period when the printing sheet is being transported to the compilation tray regardless of the thickness of the printing sheet.

In the above exemplary embodiment, although a case has been described in which the present invention is applied to a post-processing apparatus that is configured to be installed onto a printer, the present invention is not limited to such a post-processing apparatus and may also be applied to post-processing apparatuses each having any structure for performing post-processing on a sheet on which a printing operation is not performed as well as on a sheet on which a printing operation has been performed.

In the above exemplary embodiment, although a configuration has been described in which the stoppers are controlled so as to stop at positions at which the stoppers support a sheet that is to be transported next or at their home positions, the present invention is not limited to this configuration. After a sheet has been ejected as a result of being pushed toward the ejection port by the stoppers, the stoppers may be controlled so as to move in a direction opposite to the direction in which the stoppers push the sheet and then stop at the positions at which the stoppers support the sheet that is to be transported next.

In addition, in the above exemplary embodiment, although a configuration has been described in which the stoppers are detachable from the corresponding ejection belts, the present invention is not limited to this configuration, and the stoppers and the corresponding ejection belts may be integrally formed into one member.

Furthermore, in the above-described exemplary embodiment, although a configuration has been described in which two stoppers are mounted on one ejection belt, the present invention is not limited to this configuration, and each ejection belt may be provided with at least one stopper.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a storing unit configured to store a plurality of recording media for performing post-processing;

a pushing member configured to push trailing ends of the recording media stored in the storing unit toward an ejection port; and a controller configured to, if a thickness of the recording medium is not less than a predetermined threshold, control the pushing member to stop at a position at which the pushing member supports a recording medium that is transported.

2. The post-processing apparatus according to claim 1, wherein the controller is configured to, after a recording medium has been ejected as a result of being pushed toward the ejection port by the pushing member, control the pushing member to move in a direction opposite to a direction in which the pushing member pushes the recording medium and then stop at a position at which the pushing member supports another recording medium that is to be transported next.

3. The post-processing apparatus according to claim 2, wherein the controller is configured to, if processing based on a single execution instruction is complete, control the pushing member to stop at a position at which the pushing member is accommodated in an apparatus body.

4. The post-processing apparatus according to claim 1, wherein the controller is configured to, if processing based on a single execution instruction is complete, control the pushing member to stop at a position at which the pushing member is accommodated in an apparatus body.

5. The post-processing apparatus according to claim 1, further comprising:

a transport member configured to rotate while being in contact with a surface of a trailing end portion of a recording medium that is transported to transport the recording medium to the storing unit.

6. A post-processing apparatus comprising:

a storing unit configured to store a plurality of recording media for performing post-processing;

a pushing member configured to push trailing ends of the recording media stored in the storing unit toward an ejection port; and a controller configured to control the pushing member to stop at different positions in accordance with a thickness of the recording media.

7. The post-processing apparatus according to claim 6, wherein the controller is configured to, if the thickness of the recording medium is less than the predetermined threshold, control the pushing member to stop at a position at which the pushing member is accommodated in an apparatus body.

8. The post-processing apparatus according to claim 7, wherein the controller is configured to, if processing based on a single execution instruction is complete, control the pushing member stop at the position at which the pushing member is accommodated in the apparatus body.

9. The post-processing apparatus according to claim 6, wherein the controller is configured to, after a recording medium has been ejected as a result of being pushed toward the ejection port by the pushing member, control the pushing member to move in a direction opposite to a direction in which the pushing member pushes the recording medium and then stop at a position at which the pushing member supports another recording medium that is to be transported next.

10. The post-processing apparatus according to claim 9, wherein the controller is configured to, if processing based on a single execution instruction is complete, control the pushing member to stop at a position at which the pushing member is accommodated in an apparatus body.

11. The post-processing apparatus according to claim 6, wherein the controller is configured to, if processing based on a single execution instruction is complete, control the pushing member to stop at a position at which the pushing member is accommodated in an apparatus body.

* * * * *